US005694733A

United States Patent [19]

Gallemore, II

[11] Patent Number: 5,694,733

[45] Date of Patent: Dec. 9, 1997

[54] FLAG/BANNER DISPLAY SYSTEM

[75] Inventor: William E. Gallemore, II, Colleyville, Tex.

[73] Assignee: National Banner Company, Inc., Dallas, Tex.

[21] Appl. No.: 786,496

[22] Filed: Jan. 21, 1997

Related U.S. Application Data

[63] Continuation of Ser. No. 271,045, Jul. 6, 1994, abandoned.

[51] Int. Cl.[6] ..... G09F 17/00

[52] U.S. Cl. ..... 52/736.2; 52/745.17; 40/218; 40/479; 40/607; 116/173; 116/174; 248/218.4; 248/219.4

[58] Field of Search ..... 52/745.17, 721, 52/736.2, 737.2; D11/181, 182, 183, 165, 166; 116/173, 174, 175; 40/218, 602, 603, 604, 607, 479; 248/231, 218.4, 219.4

[56] References Cited

U.S. PATENT DOCUMENTS

| | | | |
|---|---|---|---|
| 1,020,396 | 3/1912 | Blank | D11/166 X |
| 1,401,626 | 12/1921 | Mader | D11/166 X |
| 1,677,379 | 7/1928 | Ames | D11/182 X |
| 1,712,691 | 5/1929 | Carlson | 116/174 |
| 3,034,242 | 5/1962 | Gold | 40/604 |
| 3,089,268 | 5/1963 | Frey et al. | 40/604 |
| 3,240,863 | 3/1966 | Brede . | |
| 3,559,941 | 2/1971 | Holzman . | |
| 3,564,743 | 2/1971 | Gilmoure | 40/604 |
| 3,812,815 | 5/1974 | Kuenzel | 116/173 X |
| 3,850,401 | 11/1974 | Snediker | 40/604 X |
| 4,325,529 | 4/1982 | Seebinger . | |
| 4,341,029 | 7/1982 | Heard . | |
| 4,593,877 | 6/1986 | Van Der Wyk | 248/512 |
| 4,880,195 | 11/1989 | Leply | 40/607 X |
| 5,070,809 | 12/1991 | Fox et al. | 116/174 |
| 5,172,881 | 12/1992 | Stein | 248/231 |
| 5,212,898 | 5/1993 | Dinan et al. . | |
| 5,267,524 | 12/1993 | Maxwell | 116/174 |
| 5,310,151 | 5/1994 | Engel . | |
| 5,320,322 | 6/1994 | Williams . | |
| 5,423,281 | 6/1995 | Crookham et al. | 116/173 |
| 5,463,973 | 11/1995 | Tait . | |

FOREIGN PATENT DOCUMENTS

| | | | |
|---|---|---|---|
| 332408 | 7/1930 | United Kingdom | 40/479 |

OTHER PUBLICATIONS

NAP 1993 World of Colors catalog, p. 17, 32–33.

National Banner Co., Inc. catalog, Dallas, Texas, 1993–1994, pp. 9, 15, 24–26, 45.

*Primary Examiner*—Wynn E. Wood

*Assistant Examiner*—Laura A. Callo

*Attorney, Agent, or Firm*—Randall C. Brown; Anthony E. J. Campbell; Locke Purnell Rain Harrell

[57] ABSTRACT

A flag/banner display system comprising a generally horizontal, cantilever mounting of a first base strut from which is mounted a pivotal strut array adapted for supporting a flag/banner therefrom. The pivotal strut array is formed in angulated fashion that pivotally moves about the end of the cantilevered base strut to thereby permit economical and aesthetically pleasing flag/banner/signage mountings capable of moving in response to wind loading and facilitating the use of interchangeable flag/banners thereon.

16 Claims, 2 Drawing Sheets

FLAG/BANNER DISPLAY SYSTEM

This application is a continuation of application Ser. No. 08/271,0465 filed on Jul. 6, 1994 now abandoned.

BACKGROUND OF THE INVENTION

1. Field of the Invention

The present invention relates to flag/banner display systems and, more particularly, to a pivotal flag/banner/sign display assembly which is permitted to move in response to wind loading.

2. History of the Prior Art

The display of flags, ribbons, signs, banners and the like dates back into ancient times. For centuries, banners have been simply supported from walls, ceilings and rigid poles for a variety of decorative and aesthetic reasons. Today, banners, signs and flags are supported from a myriad of structures for, likewise, a variety of purposes. Flags, banners and signs are used today for commercial advertisement and, thus, the economic importance of effective flag/banner displays has increased. Sign/flag/banner structures are now specifically designed for the most prominent, convenient and aesthetically pleasing presentation to the purchasing public.

The widespread use of flags/banners/billboards and related creative signage for commercial advertising has necessitated structural innovation. The size, shape and orientation of the flag/banner/sign is extremely important to the advertiser because the flag/banner sign assemblies are sold for the purpose of gaining the public's attention and often valued at their effectiveness. The display area itself must then maintain the appropriate orientation for display to the public, and it must withstand the forces of nature. In this regard, it is often advantageous to maintain the flag/banner/sign in a taut condition, properly oriented to the eyes of the viewing public. Problems occur when wind and other natural forces cause the flag/banner/sign to become rumpled, wrinkled, disoriented, and otherwise unattractively displayed about its support structure. Wind is, of course, a constant force with regard to a flag/banner or similar flaccid sign systems.

The present invention overcomes certain problems of prior art flag/banner display structures by providing a system adapted for maintaining appropriate support for the flag/banner thereon with an assembly that is both economical to fabricate and easy to install. In addition, it would be an advantage to provide a lightweight, inexpensive flag/banner/sign display that would move, or pivot, relative to wind loading to thereby maintain an orientation that is less likely to wrinkle or become dislodged in high winds.

SUMMARY OF THE INVENTION

The present invention relates to flag/banner display systems of the type incorporating a rigid, cantilever mounting upon which is secured a flag/banner strut array for suspending a banner (which term includes any of a variety of rigid or flaccid signs and advertising membranes) therefrom. More particularly, one aspect of the present invention comprises an improved, pivotal flag/banner support structure of the type wherein a banner (which term includes any indicia bearing membrane such as a flag, pennant, sign, or marker) is supported from an upstanding support pole for display therefrom. The improvement comprises a base pole adapted for extending outwardly from the support pole. Means are provided for rigidly securing the base pole to the support pole for pivotal support of the flag/banner therefrom. A first upstanding strut is provided for pivotal mounting to the base pole for upward extension therefrom and rotation relative thereto. A top strut is provided for securement to an upper end of the upstanding strut for engagement of a top portion of the flag/banner. Securement means permit the first upstanding strut to pivot relative to the base pole whereby the flag/banner and the strut assembled thereto may assume the position of least resistance in response to wind blowing thereagainst.

In another aspect, the present invention includes an improved flag/banner support structure of the type wherein a flag/banner is supported in the presence of blowing wind from an upstanding support pole for display therefrom. The improvement comprises a base pole adapted for extending outwardly from the support pole, a means for securing the base pole to the support pole for support of the flag/banner therefrom, a first upstanding strut adapted for pivotal mounting to the base pole for upward extension therefrom, a top strut adapted for securement to an upper end of the upstanding strut for engagement of a top portion of the flag/banner, means for mounting the flag/banner to the struts, and means for mounting the first upstanding strut to the base pole and permitting the first upstanding strut and flag/banner mounted thereto to pivot relative to the base pole. In this manner the flag/banner and the struts assembled thereto may assume a position of least resistance in response to wind blowing thereagainst.

The above described invention may, in another aspect, include securement means for the base pole comprising a generally C-shaped bracket adapted for placement against the support pole and at least one band for securing the bracket to the support pole. The bracket may be formed with first and second sidewall portions constructed in generally parallel spaced relationship, with the sidewall portions having at least one aperture formed therein and in registry one with the other and adapted for receipt of the band therethrough. The sidewall portions are each formed with an enlarged aperture therein, each in registry with the other, and formed of a generally rectangular configuration adapted for matingly receiving a generally rectangular base pole therethrough. The apertures for the bands may include at least four elongated, slotted portions adapted for receiving first and second bands therethrough. The bands each comprise an adjustable filament formed of metal or synthetic fibers, and the like, capable of being tightened around the support pole for the securement of the bracket thereagainst. The first upstanding strut comprises a hollow tube adapted for receiving a shaft in either end thereof. The means for mounting the first upstanding strut to the base pole comprises a shaft adapted for securement to the base pole and upstanding therefrom with the tubular upstanding strut placed thereover in rotational relationship therewith. The top strut comprises a hollow tube adapted for receiving a shaft in at least one end thereof and further including an angulated shaft adapted for receipt within the top end of the hollow, upstanding strut for extension therefrom and receipt of the hollow, top strut thereon for permitting the assembly of the top strut to an upper end of the upstanding strut and the suspension of the flag/banner therefrom. The above described struts may be made of metal, synthetic material, or the like. The flag/banner is generally rectangular in shape, having an angulated top portion adapted for conforming to the angle of the top strut relative to the upstanding strut. The flag/banner may be made of any material and clamping means may be provided for securing a lower portion of the flag/banner to a lower portion of the upstanding strut for securement of the flag/banner to the support structure.

In another aspect, the invention includes an improved method of supporting a flag/banner against blowing wind of the type wherein the flag/banner is supported from an upstanding support pole for display therefrom. The improvement comprises the steps of providing a base pole adapted for extending outwardly from the support pole, securing the base pole to the support pole for support of the flag/banner therefrom, and providing a first upstanding strut adapted for pivotal mounting to the base pole for upward extension therefrom. A top strut is provided for securement to an upward end of the upstanding strut for engagement of the top portion of the flag/banner therefrom. The flag/banner is mounted to the struts for securement therewith. The first upstanding strut and flag/banner are then allowed to pivot relative to the base pole, whereby the flag/banner and the struts assembled thereto may assume a position of least resistance in response to wind blowing thereagainst.

In another aspect of the invention, the above described method includes the step of securing the base pole to the support pole, including the step of providing a generally C-shaped bracket adapted for securement against the support pole and providing at least one band for securing the bracket to the support pole.

The method of this aspect of the invention further includes the step of forming the bracket with first and second sidewall portions having at least one aperture formed in each sidewall portion and in registry one with another for receipt of the band therethrough. The method further includes the step of forming the side wall portions of the bracket with an enlarged rectangular aperture in each sidewall portion in registry with each other and matingly receiving a generally rectangular base pole therethrough. The method further includes the step of forming at least four elongated, slotted portions within the side wall portions, the slots each being adapted for receiving one of the bands therethrough, at least one of the bands comprising an adjustable filament capable of securing the bracket to the pole.

In yet another aspect, the present invention includes an improved method of supporting a flag/banner against blowing wind of the type wherein the flag/banner is supported from an upstanding support pole for display therefrom. The improvement comprises the steps of providing a base pole adapted for extending outwardly from the support pole, securing the base pole to the support pole for support of the flag/banner therefrom, providing a first upstanding strut adapted for pivotal mounting to the base pole for upward extension therefrom, providing a top strut adapted for securement to an upward end of the upstanding strut for engagement of the top portion of the flag/banner therefrom, mounting the flag/banner to the struts for securement therewith, and allowing the first upstanding strut and flag/banner to pivot relative to the base pole. In this manner, the flag/banner and the struts assembled thereto may assume a position of least resistance in response to wind blowing thereagainst.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
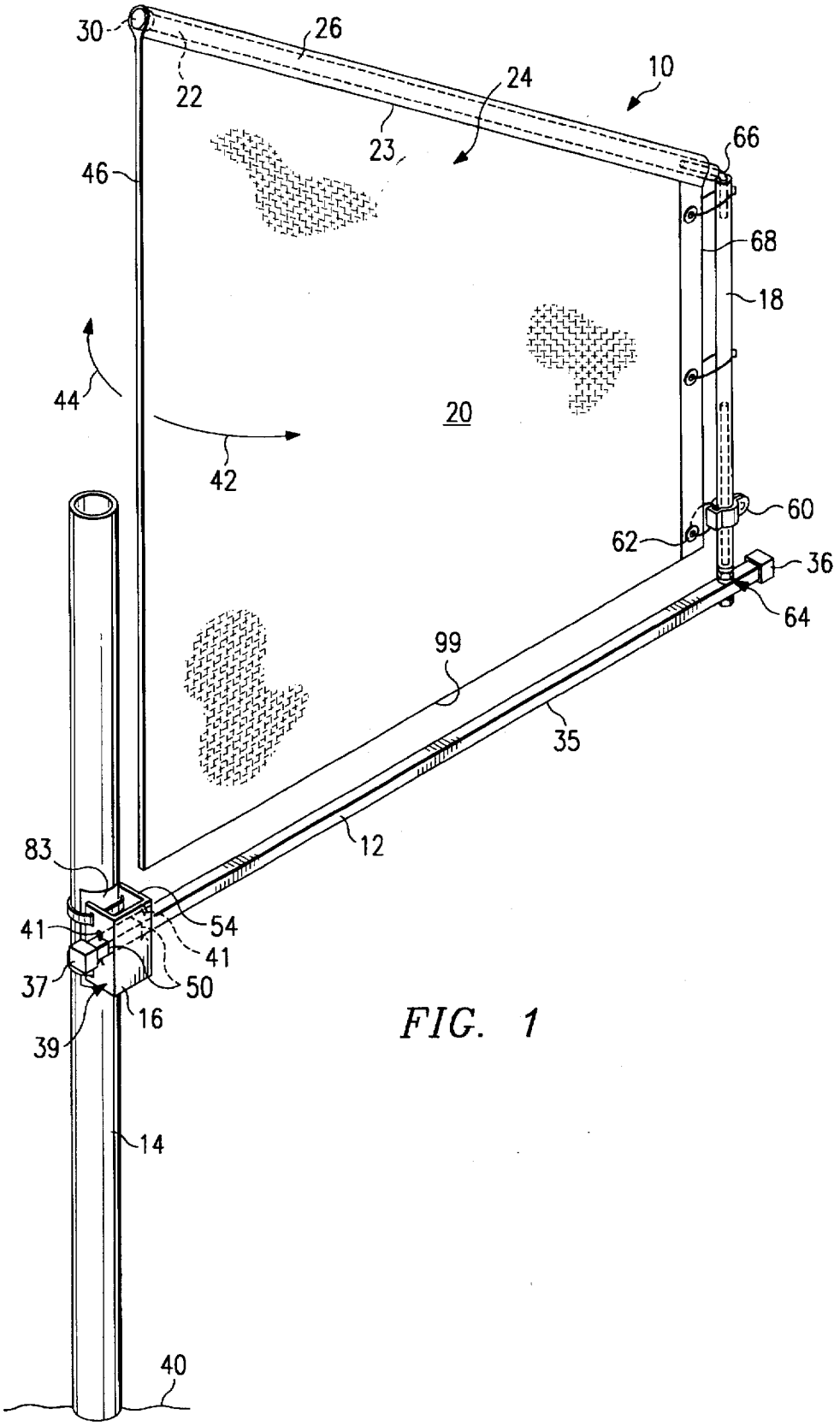
FIG. 1 is a perspective view of a flag/banner display system constructed in accordance with the principles of the present invention.

Referring first to FIG. 1 there is shown a perspective view of a flag/banner assembly 10 structured in accordance with the principles of the present invention. The assembly 10 comprises a base strut 12 mounted in a cantilever fashion from a support pole 14 by a generally C-shaped mounting bracket 16 (described in more detail below). An upstanding, hollow, strut 18 supports a flag/banner, or sign, 20 thereon. A hollow strut 22 is connected to upstanding strut 18 by an angulated shaft 66 for supporting a top region 24 of the flag/banner 20.

As used herein, the term "flag" or "flag/banner" 20 includes any membrane, with or without indicia printed thereon, such as plain material, and being adapted for support by the strut assembly described herein. The flag/banner 20 may have information or other printing thereon for display from the flag/banner assembly 10. In no respect does the term "flag/banner" or "flag" or "banner" alone as used herein, or in the claims, limit the type of display membrane that may be secured to, and exhibited from, the struts 18 and 20 as hereinafter described.

Still referring to FIG. 1, the flag/banner 20 is shown to be constructed in a generally rectangular configuration. The term "rectangular" includes the flag/banner shape of the type shown in FIG. 1 wherein a curved, angled or straight upper membrane portion may form the top region 24. In this particular embodiment, the top region 24 is formed with a straight seamed sleeve 26 extending at an angle on the order of 120° from the side 68. The sleeve 26 forms a closed end tubular region constructed for receipt of the strut 22 therethrough. The end of strut 22 preferably includes a cap 30 to prevent the wearing of material by a bare, rough end of said strut. The cap 30 is sufficiently small to pass within the sleeve 26. A seam 23 forms the sleeve 26 for receiving the strut 22 therein and defines the section of the flag/banner 20 adapted for securement to the upper strut 22. The strut 22 is shown in phantom in this view since it is enclosed in the sleeve 26.

Referring still to FIG. 1, the base strut 12 is constructed of a generally rectangular (including square) body portion 35 having an end cap 36 formed on the distal end thereof. A second end cap 37 is formed on the end 39 of strut 12 adjacent the bracket 16 secured to support pole 14. Cap 37 is formed for press fit engagement of the end 39 and thus has a mating shape to strut body portion 35. As shown herein, support pole 14 upstands from a base or ground region 40. Base or ground region 40 may also include the top of a building or other structure adapted for securement of a support pole 14 therefrom. Fasteners such as cotter pins 41 are used to secure the position of the strut 12 relative to the bracket 16. Additionally, the cotter pins 41 are easily removed to permit the strut 12 to slide toward the pole 14 for servicing and installation of the flag banner 20.

Referring still to FIG. 1, the assembled flag/banner 20 is permitted to move in response to wind loading in the direction of arrows 42 and 44 with unsupported edges 46 and 179 depending from the angulated strut 22 and terminating above the base strut 12. The generally rectangular body of base strut 12 further provides structural support of the assembly 10 by eliminating rotation thereof relative to the bracket 16. As shown here, the bracket 16 contains generally rectangular, aligned apertures 50 in opposite sidewalls 52 and 54 thereof. The apertures slidably receive the base strut 12 therethrough during assembly. A clamp 60 is shown positioned upon upstanding strut 18 for securing a lower corner 62 of the flag/banner 20 to the strut 18 for securement. The upstanding strut 18 is further supported from the base strut 12 by a shaft assembly 64 described in more detail below. An upper angulated shaft 66 connects the upstanding strut 18 and angulated strut 22 for support of the flag/banner 20 therefrom. Additional flag/banner attachments may be provided along the edge 68 of flag/banner 20 for connection to the upstanding strut 18. These connecting elements could be clamps, tethers, wires or the like. A single clamp 60 is shown in this particular embodiment and in FIG. 2 for purposes of illustration.

Figure 2:
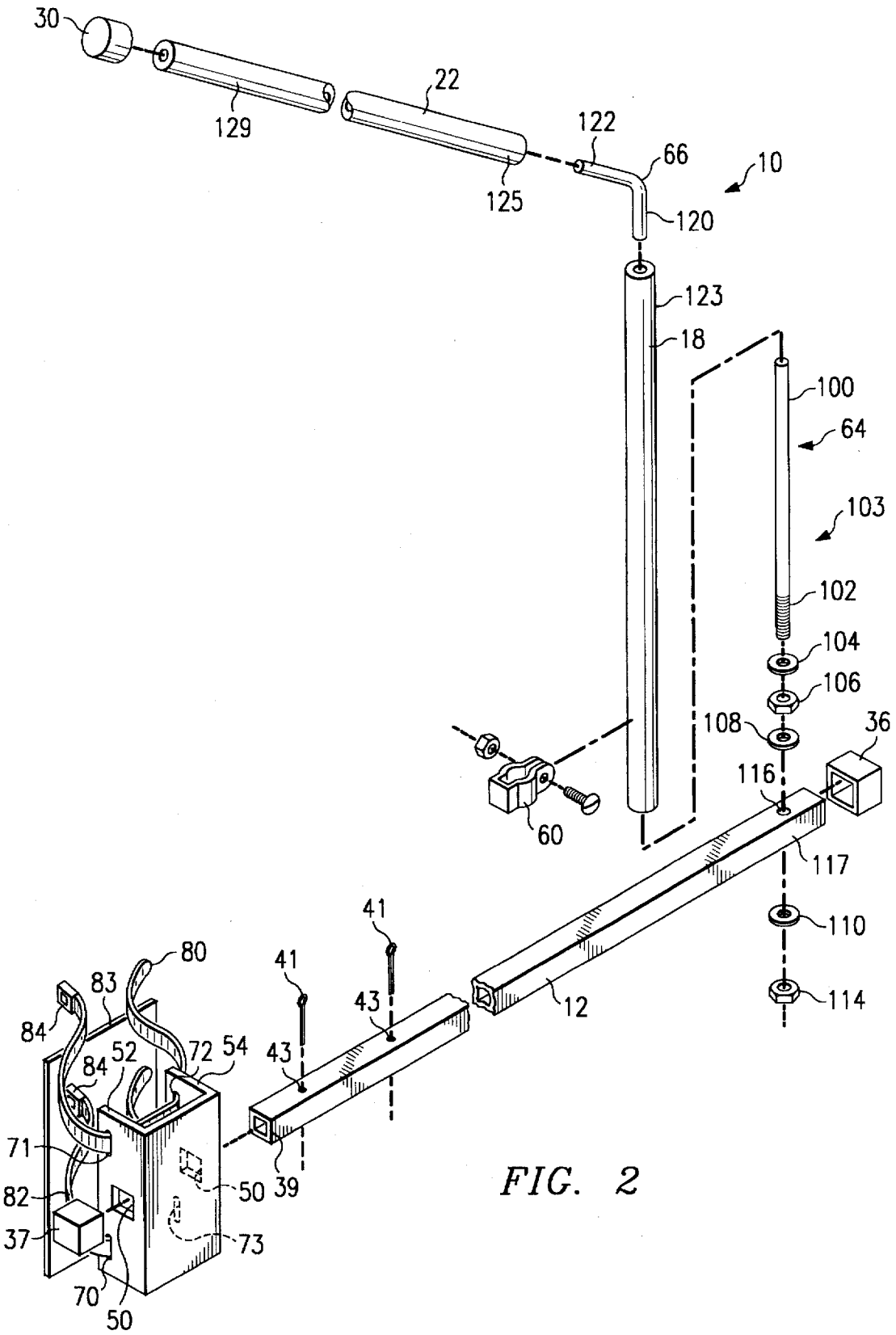
FIG. 2 is an enlarged, perspective, exploded view of the system of FIG. 1.

Referring now to FIG. 2, there is shown an enlarged, exploded, perspective view of the assembly 10 of FIG. 1. In this particular view, the bracket 16 is shown to be constructed with the generally rectangular slots 50 formed in opposite sides 52 and 54 of the bracket 16. A second slot 50 shown in phantom is formed in side 54 in a position for receipt of the base strut 12 therethrough. The slots 50 are formed in registry with one another for receiving the base strut 12 therethrough for support of the assembly 10. Cap 37 is, of course, shown in position for receiving the end 39 of support strut 12 therein after passing through the apertures 50 of the bracket 16. The cotter pins 41 described above are received within the apertures 43 which are drilled through opposite sides of the body portion 35 of strut 12. The cotter pins 41 are easily installed and removed and, once in place, minimize relative movement between the bracket 16 and the strut 12.

Referring still to FIG. 2, the bracket 16 includes a series of angulated slots 70, 71, 72, and 73 (shown in phantom) for receiving the fastener straps 80 and 82 therethrough. Fastener straps 80 and 82 are adapted for mounting the bracket 16 against the pole 14 (shown in FIG. 1) in secured engagement therewith. A gasket 83 mode of rubber, or the like, may be used as a mounting pad that improves the fractional engagement of the pole 14 (shown in FIG. 1) by the bracket 16. A gasket 83 is shown in FIGS. 1 and 2 as an optional feature. Strap locking elements 84 are provided on the ends of the fastener straps 80 and 82 for securing engagement thereof. The fastener straps 80 and 82 maybe formed of metal, synthetic material (such as plastic) or the like and may be of a quality which is conventionally used for securement of brackets to poles for the suspension of flag/banners therefrom. In that regard, a generally C-shaped bracket similar to that shown as bracket 16 but formed with a round hold in place of the generally rectangular hole 50 has been used in the prior art for receipt of a round rod or pole therethrough and the suspension of flags, pennants and/or banners therefrom. Such a pole can obviously rotate from wind loading or the like. In the present invention, the bracket 16 comprises a rectangular hole specifically configured for the receipt and mating engagement of a generally rectangular pole base strut 12 therethrough to prevent the base strut from rotating under the influence of wind loading thereabove. The construction of the fastener straps 80 and 82 as well as the bracket 16 may be of conventional materials such as steel, aluminum and synthetics. The present invention overcomes the disadvantages of prior art systems by utilizing a configuration permitting the upstanding display of a flag/banner 20, of the type shown in FIG. 1, in a position allowing the pivotal movement thereof in a lightweight, economical assembly.

Referring still to FIG. 2, the extension of the base strut 12 from the bracket 16 secured to pole 14 (shown in FIG. 1) provides the basic cantilever support of the upstanding strut 18. The upstanding strut 18 is formed of a generally hollow tube adapted for receiving the shaft assembly 64 therein. Shaft assembly 64 includes an elongate shaft 100, preferably made of solid metal, or the like having a threaded section 102 formed on its lower end 103. The utilization of a first washer 104, nut 106, second washer 108, third washer 110, and lock nut 114 provide securement of the shaft 100 in the aperture 116 formed in the end 117 of base strut 12. Cap 36 is secured adjacent to the shaft assembly 64. The receipt of the hollow strut 18 over the shaft 100 positions the strut 18 to sit on washer 104 and facilitates the rotation of the upstanding strut 18 relative thereto and the pivotal action of the flag/banner 20 shown in FIG. 1.

Referring still to FIG. 2, the angulated shaft 66 is shown constructed with a lower region 120 and an upper region 122 adapted for receipt within upper hollow section 123 of upstanding strut 18 and lower region 125 of strut 22, respectively. The strut 22 is likewise preferably formed of a hollow configuration so that it may be received upon the region 122 of angulated shaft 66. End cap 30 is also illustrated for receipt on the end 129 of strut 22 as shown in FIG. 1 for restricting wear of the sleeve 26 of the flag/banner therefrom (as shown in FIG. 1).

Referring now to FIGS. 1 and 2 in combination, the generally C-shaped bracket 16 is fabricated from aluminum, steel, synthetics, or the like for receipt of a rectangular base strut 12 found of aluminum, steel or the like as well as receipt of at least one fastener strap 80 and preferably two fastener straps 80 and 82 therethrough. The fastener straps 80 and 82 are tightened about the pole 14 to press the bracket 16 thereagainst in the configuration preventing any relative movement between the bracket 16 and the pole 14. With the introduction of the base strut 12 therein and the placement of the cap 37 thereover, the base strut 12 is in a position for supporting the flag/banner 20 upstanding therefrom. The threaded mounting of the shaft 100 by the threaded elements described above afford an economical unit that is easily assembled in the field. Any variety of flag/banners may be suspended from the struts 18 and 22 as described herein and other angles maybe afforded by changing the angle of the angulated shaft 66 described above. A rectangular flag/banner may, for example, be provided by providing angle shaft 66 in a right angle configuration. When natural forces engage the flag/banner 20, such as rain, wind, or the like, the flag/banner 20 acts much like a boat sail that is not tied down and is able to freely pivot to a position of least resistance to the force.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A flag/banner support apparatus of the type wherein a banner is supported from an upstanding support pole for display therefrom, said apparatus comprising:

a generally rectangular base pole extending tangentially from the support pole;

a generally C-shaped bracket adapted for placement against said support pole and having first and second sidewalls, each said sidewall having corresponding generally rectangular apertures for slidingly receiving said generally rectangular base pole therethrough and securing said base pole to said support pole for support of the flag/banner therefrom;

at least one removable fastener for fastening said base pole to said C-shaped bracket, said at least one removable fastener alternately permitting or preventing relative sliding movement of said base pole with respect to said C-shaped bracket;

a first upstanding strut pivotally mounted to and upwardly extending from said base pole, a side portion of said flag/banner being mounted on said first upstanding strut; and a top strut engaged with an upper end of said upstanding strut, a top portion of said flag/banner being mounted on said top strut;

wherein said flag/banner and said struts assume a position of least resistance in response to wind blowing thereagainst.

2. The apparatus as set forth in claim 1, wherein said C-shaped bracket further comprises at least one fastener strap for securing said C-shaped bracket to said support pole.

3. The apparatus as set forth in claim 2, wherein said first and second sidewalls of said bracket are constructed in generally parallel spaced relationship, each said sidewall having at least one aperture formed therein and in registry one with the other, each said at least one aperture being adapted for receipt of said strap therethrough.

4. The apparatus as set forth in claim 3, wherein said apertures for said straps include at least four elongated, slotted portions adapted for receiving first and second straps therethrough, said straps each comprising an adjustable filament capable of being tightened to said pole for the securement of said bracket thereagainst.

5. The apparatus as set forth in claim 1 wherein said base pole includes aligned apertures adapted for receiving said removable fasteners therethrough, said apertures being spaced one from the other for poitioning on opposite sides of said C-shaped bracket with said base pole extending through said apertures thereof, and said removable fasteners comprising cotter pins adapted for receipt in and securement through said aligned apertures for securement of said base pole relative to said C-shaped bracket.

6. The apparatus as set forth in claim 1, wherein said first upstanding strut comprises a hollow tube adapted for receiving a shaft in either end thereof.

7. The apparatus as set forth in claim 6, wherein said pivot means for mounting said first upstanding strut to said base pole comprises a shaft adapted for securement to said base pole and upstanding engagement therefrom with said tubular upstanding strut placed thereover in rotational relationship therewith.

8. The apparatus as set forth in claim 6, wherein said top strut comprises a hollow tube adapted for receiving a shaft in at least one end thereof and further including an angulated shaft adapted for receipt within the top end of said hollow, upstanding strut for extension therefrom and receipt of said hollow, top strut thereon for permitting the assembly of said top strut to an upper end of said upstanding strut and the suspension of said flag/banner therefrom.

9. The apparatus as set forth in claim 1, wherein said flag/banner is generally rectangular in shape, having an angulated top portion adapted for conforming to the angle of said top strut relative to said upstanding strut.

10. The apparatus as set forth in claim 9 and further including clamping means for securing a lower portion of said flag/banner to a lower portion of said upstanding strut for securement of said flag/banner to said support structure.

11. A method of supporting a flag/banner from an upstanding support pole for display therefrom, comprising the steps of:

(a) providing a generally rectangular base pole extending tangentially from said support pole;

(b) securing said base pole to said support pole for support of said flag/banner therefrom, said securing step comprising the steps of:

(i) providing a generally C-shaped bracket adapted for securement against said support pole;

(ii) forming said C-shaped bracket with first and second sidewalls having a rectangular aperture in each and in registry with each other and slidingly receiving said generally rectangular base pole therethrough; and (iii) providing removable fasteners for fastening said base pole to said C-shaped bracket, said removable fasteners alternately permitting or preventing relative sliding movement of said base pole with respect to said C-shaped bracket;

(c) providing a first upstanding strut adapted for pivotal mounting to said base pole for upward extension therefrom;

(d) providing a top strut adapted for securement to an upward end of said upstanding strut for engagement of the top portion of said flag/banner therefrom;

(e) mounting said flag/banner to said struts for securement therewith; and (f) allowing said first upstanding strut and flag/banner to pivot relative to said base pole, whereby said flag/banner and said struts assembled thereto assume a position of least resistance in response to wind blowing thereagainst.

12. The method as set forth in claim 11, wherein said securing step further comprises the step of:

providing at least one band for securing said C-shaped bracket to said support pole.

13. The method as set forth in claim 12, and further including the step of forming said first and second sidewall portions of said C-shaped bracket with at least one aperture formed in each and in registry with one another for receipt of said band therethrough.

14. The method as set forth in claim 13, and further including the step of forming at least four elongated, slotted portions within said side wall portions, said slots each being adapted for receiving one of said bands therethrough, at least one of said bands comprising an adjustable filament capable of securing said bracket to said pole.

15. The method as set forth in claim 11, and including the step of forming said first upstanding strut from a hollow tube adapted for receiving a shaft in either end thereof.

16. The method as set forth in claim 15, and including the steps of providing a shaft and mounting said shaft to said base pole in an upstanding relationship therefrom, and the step of placing said tubular upstanding strut thereover in rotational relationship therewith.

* * * * *